US010836980B2

(12) United States Patent
Saint Victor

(10) Patent No.: US 10,836,980 B2
(45) Date of Patent: Nov. 17, 2020

(54) ACIDIC HARD SURFACE CLEANER WITH GLYCINE BETAINE AMIDE

(71) Applicant: S. C. Johnson & Son, Inc., Racine, WI (US)

(72) Inventor: Marie-Esther Saint Victor, Glencoe, IL (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 15/774,203

(22) PCT Filed: Nov. 17, 2016

(86) PCT No.: PCT/US2016/061149
§ 371 (c)(1),
(2) Date: May 7, 2018

(87) PCT Pub. No.: WO2017/099932
PCT Pub. Date: Jun. 15, 2017

(65) Prior Publication Data

US 2018/0327692 A1 Nov. 15, 2018

Related U.S. Application Data

(60) Provisional application No. 62/263,924, filed on Dec. 7, 2015.

(51) Int. Cl.

| | |
|---|---|
| ***C11D 1/90*** | (2006.01) |
| ***C11D 3/20*** | (2006.01) |
| ***C11D 3/22*** | (2006.01) |
| ***C11D 3/30*** | (2006.01) |
| ***C11D 11/00*** | (2006.01) |
| *C11D 3/04* | (2006.01) |

(52) U.S. Cl.
CPC ..... *C11D 1/90* (2013.01); *C11D 3/2086* (2013.01); *C11D 3/222* (2013.01); *C11D 3/30* (2013.01); *C11D 11/0023* (2013.01); *C11D 3/042* (2013.01)

(58) Field of Classification Search
None
See application file for complete search history.

(56) References Cited

U.S. PATENT DOCUMENTS

| | | | | |
|---|---|---|---|---|
| 727,948 | A | 5/1903 | Higgins | |
| 3,578,499 | A | 5/1971 | Crotty et al. | |
| 3,681,141 | A | 8/1972 | Muoio | |
| 3,955,986 | A | 5/1976 | Miller | |
| 4,020,100 | A | 4/1977 | Evans et al. | |
| 4,370,272 | A | 1/1983 | Wechsler et al. | |
| 4,578,207 | A | 3/1986 | Holdt et al. | |
| 4,690,818 | A * | 9/1987 | Puchalski, Jr. | A61K 8/042 424/70.14 |
| 4,911,858 | A | 3/1990 | Bunczk et al. | |
| 4,943,612 | A | 7/1990 | Morita et al. | |
| 5,047,167 | A | 9/1991 | Steyn et al. | |
| 5,213,792 | A | 5/1993 | Grundmann et al. | |
| 5,254,290 | A | 10/1993 | Blandizux et al. | |
| 5,336,427 | A | 8/1994 | Bunczk et al. | |
| 5,429,755 | A | 7/1995 | Ilardi et al. | |
| 5,460,742 | A | 10/1995 | Cavanagh et al. | |
| 5,466,395 | A | 11/1995 | Tosaka et al. | |
| 5,472,629 | A | 12/1995 | Lysy et al. | |
| 5,527,477 | A | 6/1996 | Ilardi et al. | |
| 5,562,850 | A | 10/1996 | Woo et al. | |
| 5,579,842 | A | 12/1996 | Riley | |
| 5,591,376 | A | 1/1997 | Kiewert et al. | |
| 5,663,138 | A | 9/1997 | Ilardi et al. | |
| 5,849,310 | A | 12/1998 | Trinh et al. | |
| 5,877,135 | A | 3/1999 | Hahn | |
| 5,961,999 | A * | 10/1999 | Bimczok | 424/401 |
| 5,985,808 | A | 11/1999 | He et al. | |
| 6,087,309 | A | 7/2000 | Vinson et al. | |
| 6,333,299 | B1 | 12/2001 | Pace et al. | |

(Continued)

FOREIGN PATENT DOCUMENTS

| | | | | |
|---|---|---|---|---|
| AU | 81384/91 | | 11/1991 | |
| DE | 3527974 | A1 * | 2/1987 | A61K 8/44 |

(Continued)

OTHER PUBLICATIONS

Abstract of JP A-6-141797 (1985).
Covis, R., et al., Interactions and hybrid complex formation of anionic algal polysaccharides with a cationic glycine betaine-derived surfactant, Carbohydrate Polymers, vol. 121, Jan. 8, 2015, pp. 436-448.
Goursaud, F., et al., Glycine betaine as a renewable raw material to "greener" new cationic surfactants, Green Chemistry, Royal Society of Chemistry, GB, No. 10, Jan. 10, 2008, pp. 310-320.
Written Opinion for International Application PCT/US2016/061149, dated Feb. 3, 2017, 7 pages.

(Continued)

*Primary Examiner* — Necholus Ogden, Jr.

(57) ABSTRACT

Provided are cleaning compositions that may include (a) a glycine betaine amide, (b) an acidifying agent, (c) polysaccharide thickener, and (d) water. Commonly, the glycine betaine amide may include one or more compounds of formula (I): $M_{e3}N^{+}$—$CH_2$—C(O)—NH—R $X^{-}$ (I) wherein R is an aliphatic group having 8 to 22 carbon atoms and $X^{-}$ represents an inorganic or organic anion. Commonly, the composition has a pH of no more than about 4, a viscosity of no more than about 1,500 cP at a shear rate of 10 at 25° C., and/or a viscosity of at least about 250 cP at a shear rate of 50 at 25° C. (where the viscosities are determined with a Brookfield Cone/Plate viscometer). The cleaning composition may exhibit a unique sheer thinning profile, such that the composition thins less after being sprayed onto a surface and thereby provides a longer contact time than conventional products.

25 Claims, 5 Drawing Sheets

(56) References Cited

U.S. PATENT DOCUMENTS

| | | | |
|---|---|---|---|
| 6,336,977 | B1 | 1/2002 | Menke et al. |
| 6,384,266 | B1 | 5/2002 | Farone et al. |
| 6,407,051 | B1 | 6/2002 | Smith et al. |
| 6,486,333 | B1 | 11/2002 | Murayama et al. |
| 6,491,933 | B2 | 12/2002 | Lorenzi et al. |
| 6,586,639 | B2 | 7/2003 | Murayama et al. |
| 6,624,126 | B1 | 9/2003 | Kasuga et al. |
| 6,667,286 | B1 | 12/2003 | Dettinger et al. |
| 6,701,940 | B2 | 3/2004 | Tsibouklis et al. |
| 6,914,075 | B2 | 7/2005 | Nakano et al. |
| 7,018,970 | B2 | 3/2006 | Hsu et al. |
| 7,022,661 | B2 | 4/2006 | Behler et al. |
| 7,053,033 | B2 | 5/2006 | Scheper |
| 7,229,958 | B2 | 6/2007 | Kohle et al. |
| 7,591,272 | B2 | 9/2009 | Dastbaz et al. |
| 7,662,225 | B2 | 2/2010 | Antoine et al. |
| 7,718,595 | B2 | 5/2010 | Murphy et al. |
| 7,829,521 | B2 | 11/2010 | Antoine et al. |
| 7,919,447 | B1 | 4/2011 | Klinkhammer et al. |
| 7,981,856 | B2 | 7/2011 | Antoine et al. |
| 8,143,205 | B2 | 3/2012 | Klinkhammer et al. |
| 8,143,206 | B2 | 3/2012 | Klinkhammer et al. |
| 8,440,600 | B2 | 5/2013 | Klinkhammer et al. |
| 8,444,771 | B2 | 5/2013 | Leipold et al. |
| 8,461,093 | B2 | 6/2013 | Leipold et al. |
| 8,629,092 | B2 | 1/2014 | Woo et al. |
| 8,658,588 | B2 | 2/2014 | Wortley et al. |
| 8,835,371 | B2 | 9/2014 | Leipold et al. |
| 8,980,813 | B2 | 3/2015 | Klinkhammer et al. |
| 8,993,502 | B2 | 3/2015 | Klinkhammer et al. |
| 9,068,145 | B1 | 6/2015 | Klinkhammer et al. |
| 9,068,152 | B2 | 6/2015 | Klinkhammer et al. |
| 9,102,906 | B2 | 8/2015 | Leipold et al. |
| 9,169,456 | B2 | 10/2015 | Klinkhammer et al. |
| 9,175,248 | B2 | 11/2015 | Klinkhammer et al. |
| 9,181,515 | B2 | 11/2015 | Klinkhammer et al. |
| 9,187,720 | B2 | 11/2015 | Leipold et al. |
| 9,243,214 | B1 | 1/2016 | Klinkhammer et al. |
| 9,399,752 | B2 | 7/2016 | Klinkhammer et al. |
| 9,410,111 | B2 | 8/2016 | Wortley et al. |
| 9,481,854 | B2 | 11/2016 | Wortley et al. |
| 9,637,902 | B2 | 5/2017 | Burt et al. |
| 9,644,359 | B2 | 5/2017 | Burt et al. |
| 9,771,544 | B2 | 9/2017 | Klinkhammer et al. |
| 9,909,086 | B2 | 3/2018 | Saint Victor et al. |
| 2002/0151446 | A1 | 10/2002 | Piterski et al. |
| 2003/0083210 | A1 | 5/2003 | Goldberg et al. |
| 2003/0125220 | A1 | 7/2003 | Dykstra et al. |
| 2005/0090422 | A1 | 4/2005 | Lukenbach et al. |
| 2005/0129626 | A1 | 6/2005 | Koivisto et al. |
| 2005/0215448 | A1 | 9/2005 | Evers et al. |
| 2006/0111262 | A1 | 5/2006 | Conzelmann et al. |
| 2006/0204526 | A1 | 9/2006 | Lathrop et al. |
| 2009/0053323 | A1 | 2/2009 | Tichy et al. |
| 2009/0215909 | A1 | 8/2009 | Wortley et al. |
| 2009/0325839 | A1 | 12/2009 | Wortley et al. |
| 2011/0166105 | A1 | 7/2011 | Farng et al. |
| 2012/0108490 | A1 | 5/2012 | Wortley et al. |
| 2012/0232170 | A1 | 9/2012 | Klinkhammer et al. |
| 2013/0291764 | A1 | 11/2013 | Mehalebi et al. |
| 2013/0338227 | A1* | 12/2013 | Saint Victor ..... C11D 1/90 514/551 |
| 2014/0037569 | A1 | 2/2014 | Leipold et al. |
| 2014/0248220 | A1 | 9/2014 | Abram et al. |
| 2014/0298577 | A1 | 10/2014 | Burt et al. |
| 2014/0356311 | A1 | 12/2014 | Leipold et al. |
| 2016/0340621 | A1 | 11/2016 | Wortley et al. |
| 2016/0355765 | A1 | 12/2016 | Klinkhammer et al. |
| 2017/0009189 | A1 | 1/2017 | Rees et al. |
| 2017/0015958 | A1 | 1/2017 | Rodrigues |
| 2017/0015959 | A1 | 1/2017 | Rodrigues |
| 2017/0034793 | A1 | 2/2017 | Uchino et al. |
| 2017/0058240 | A1 | 3/2017 | Wortley et al. |
| 2017/0362540 | A1 | 12/2017 | Klinkhammer et al. |

FOREIGN PATENT DOCUMENTS

| | | | |
|---|---|---|---|
| DE | 35 27 974 | A1 | 8/1994 |
| EP | 0 192 145 | A2 | 8/1986 |
| EP | 0 631 788 | | 1/1995 |
| EP | 0 844 303 | A2 | 5/1998 |
| EP | 1 978 080 | A1 | 10/2008 |
| GB | 2 280 906 | | 2/1995 |
| GB | 2 288 186 | | 10/1995 |
| WO | WO-96/38528 | | 12/1996 |
| WO | WO-97/05232 | | 2/1997 |
| WO | WO-97/08284 | | 3/1997 |
| WO | WO-97/40133 | | 10/1997 |
| WO | WO-02/26925 | A1 | 4/2002 |
| WO | WO-03/066797 | A1 | 8/2003 |
| WO | WO-2005/121294 | | 12/2005 |
| WO | WO-2015/091678 | A1 | 6/2015 |
| WO | WO-2017/034792 | | 3/2017 |
| WO | WO-2017/034793 | | 3/2017 |

OTHER PUBLICATIONS

Matheson et al., "Peaked Distribution Ethoxylates—Their Preparation, Characterization and Performance Evaluation", Journal of American Oil Chemistry Society vol. 63, No. 3, Mar. 1986, pp. 365-370.

* cited by examiner

ACIDIC HARD SURFACE CLEANER WITH GLYCINE BETAINE AMIDE

CROSS-REFERENCE TO RELATED APPLICATIONS

The present application is a national stage entry of International Patent Application No. PCT/US16/061149, filed on Nov. 17, 2016, which claims the benefit of and priority to U.S. Application No. 62/263,924, filed on Dec. 7, 2015, each of which is incorporated herein by reference in its entirety.

BACKGROUND

It would be advantageous to have cleaning compositions, which have a unique shear thinning profile. In particular, it may be desirable to have such compositions, which thin less after being sprayed onto a hard surface, e.g, of a shower or toilet, than conventional cleaning products. It may also be desirable for such compositions to be derived from natural products. Additionally, such compositions may advantageously exhibit sanitizing, disinfecting, biofilm prevention and disruption efficacy, and/or be compatible with a wide range of additional ingredients such as fragrance, dyes, and other cleaning agent auxiliary ingredients.

SUMMARY

The present application relates generally to the field of cleaning compositions and, in particular, cleaning compositions which may be especially useful for cleaning hard surfaces, such as the inside surface of a toilet bowl. The present application provides cleaning compositions, which may exhibit a unique shear thinning profile, such that the compositions thin less after being sprayed onto a surface and thereby provide a longer contact time than conventional cleaning products. The present cleaning compositions may include (a) a glycine betaine amide, (b) an acidifying agent, (c) polysaccharide thickener, and (d) water. Commonly, the composition has a pH of no more than about 4, a viscosity of no more than about 1,500 cP at a shear rate of 10 at 25° C., and/or a viscosity of at least about 150 cP at a shear rate of 50 at 25° C. (where the viscosities are determined with a Brookfield Cone/Plate viscometer). In certain embodiments, composition may have a 10/50 shear rate ratio of no more than about 3.

Often, the glycine betaine amide may be a compound of formula (I):

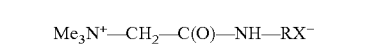

$$Me_3N^+—CH_2—C(O)—NH—RX^- \quad (I)$$

wherein R is an aliphatic group having 8 to 22 carbon atoms and $X^-$ represents an inorganic or organic anion. Typically, $X^-$ represents an alkanesulphonate anion, such as a methanesulphonate anion.

In some embodiments, the cleaning composition may have a unique shear thinning profile, such that the composition thins less after being sprayed onto a surface and thereby provides a longer contact time than conventional products. In some embodiments, the composition may have a 10/50 shear rate ratio of no more than about 3.5, no more than about 3, or more desirably no more than about 2.5. As used herein, the term "10/50 shear rate ratio" refers to the ratio of the viscosity of the composition at a shear rate of 10 at 25° C. to the viscosity of the composition at a shear rate of 50 at 25° C. In some embodiments, the compositions may have a 10/50 shear rate ratio of about 2 to 3. In some embodiments, the composition may have a viscosity of at least about 1000 cP at a shear rate of 10 at 25° C. In some embodiments, the composition may have a viscosity of at least about 150 cP at a shear rate of 50 at 25° C. In some embodiments, the composition may have a viscosity of about 250 to 1,200 cP at a shear rate of 10 at 25° C. In some embodiments, the composition may have a viscosity of about 100 to 1000 cP, or at least about 150 cP and, in some instances, at least about 250 cP at a shear rate of 50 at 25° C.

The acidifying agent may include mineral acid, such as hydrochloric acid, an alkanesulphonic acid, such as methanesulfonic acid and/or one or more carboxylic acids, e.g., one or more hydroxycarboxylic acids. Nonlimiting examples of suitable hydroxycarboxylic acids include lactic acid, citric acid, tartaric acid, xylonic acid and gluconic acid. Examples of other suitable carboxylic acids include acetic acid, propionic acid, malonic acid, succinic acid and glutaric acid.

The polysaccharide thickener may include starch, modified starch (e.g., a starch modified to include functional groups—a "functional starch"), agar, carrageenan, pectin, alginate, pectin, cellulose, and/or a cellulose derivative. In some embodiments, the polysaccharide thickener may include a natural gum. In some embodiments, the polysaccharide thickener may include agar, carob gum, guar gum, gellan gum, xanthan gum, and/or acacia gum.

The cleaning composition may include other ingredients, such as one or more of an antimicrobial agent, a bleaching agent, a fragrance, and dye component. In some embodiments, in addition to the glycine betaine amide, the composition may optionally include an additional surfactant selected from nonionic, anionic, cationic, zwitterionic, and/or amphoteric surfactants and mixtures thereof.

In some embodiments, it may be advantageous to use a "crude" or "semi-purified" form of the glycine betaine amide. As used herein the term "crude" in reference to the glycine betaine amide is understood to mean the reaction product as formed from the reaction of glycine betaine with an aliphatic alcohol (typically a lower alkanol, such as n-butanol) in the presence of an acid (typically methanesulfonic acid) and subsequent reaction of the intermediate reaction product (a glycine betaine ester) with an aliphatic amine, i.e., the final reaction product as is, and used without further treatment or purification. The terms "semi-pure" or "semi-purified" in reference to the glycine betaine amide are understood to mean that the reaction product formed is partly purified, i.e., residual glycine betaine, aliphatic alcohol and/or aliphatic amine are at least partially removed to provide a mixture which is still not a pure sample of the glycine betaine amide. Such "crude" or "semi-purified" glycine betaine amide components may be especially useful as surfactants in the present cleaning compositions. The "crude" and "semi-purified" glycine betaine amide components employed in the present cleaning compositions typically include at least 50 wt. % and, commonly, at least 60 wt. % of the glycine betaine amide.

In one embodiment, the cleaning compositions may include a mixture of a glycine betaine amide of Formula (I):

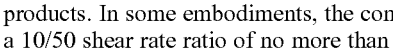

$$Me_3N^+—CH_2—C(O)—NH—RX^- \quad (I)$$

wherein R is an aliphatic group having 8 to 22 carbon atoms and $X^-$ represents an inorganic or organic counterion, and one or more of $Me_3N^+—CH_2—CO_2H\ X^-$ ("glycine betaine salt"), an aliphatic amine $RNH_2$, where R is as defined, or a salt thereof (e.g., $RNH_3^+\ X^-$), and an acid HX. Typically, $X^-$ represents an alkanesulphonate anion, such as a methanesulphonate anion and the acid HX is an alkanesulphonic acid, such as a methanesulphonic acid. As used herein, the term "glycine betaine salt" refers to the ionic compound $Me_3N^+$—$CH_2$—$CO_2H$ $X^-$, where $X^-$ represents an inorganic or organic counterion, typically a methanesulphonate counterion. For example, a "crude" or "semi-purified" glycine betaine amide may include a glycine betaine amide of Formula (I) where R is a lauric group and one of more of methanesulphonic acid, lauric amine ($RNH_2$ where R is a lauric group), and a methanesulphonate salt of lauric amine.

In some embodiments, the compositions may be exhibit properties such as sanitizing, disinfecting, and/or biofilm prevention and disruption efficacy.

DETAILED DESCRIPTION

Figure 1:
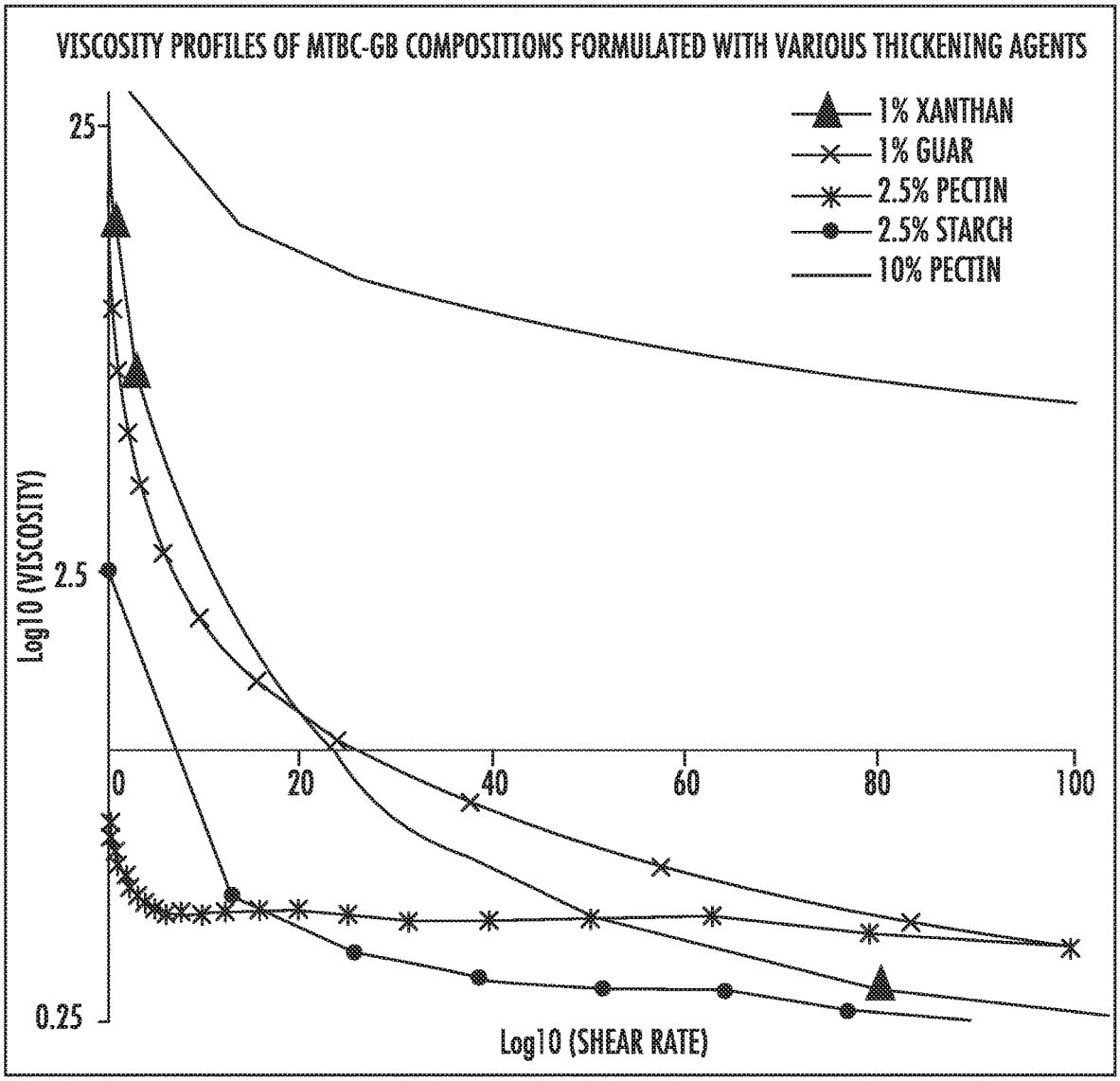
FIG. 1 is a graph illustrating the rheology profiles of a number of GB Amide-based MTBC compositions formulated with various thickening agents (1% xanthan, 1% guar, 2.5% pectin, 2.5% starch, or 10% pectin).

In one aspect, the composition may be a liquid cleaning composition that includes (a) a glycine betaine amide of formula (I):

$$Me_3N^+—CH_2—C(O)—NH—RX^- \quad (I)$$

wherein R is an aliphatic group having 8 to 22 carbon atoms and $X^-$ represents an inorganic or organic anion; (b) an acidifying agent; (c) polysaccharide thickener; and (d) water. The composition may have a pH of no more than about 4, a viscosity of no more than about 1,500 cP at a shear rate of 10 at 25° C., and a viscosity of at least about 250 cP at a shear rate of 50 at 25° C. (viscosities determined with a Brookfield Cone/Plate viscometer). In some embodiments, the composition may include at least about 85 wt. %, at least about 90 wt. %, or often at least about 95 wt. % water.

Glycine Betaine is a natural material derived from sugar beet molasses. The present glycine betaine amides may be derived from natural Glycine Betaine, providing a green (eco-friendly) and multifunctional material. Particularly of use is a glycine betaine amide of formula (I):

$$Me_3N^+—CH_2—C(O)—NH—RX^- \quad (I)$$

where R may be an aliphatic group having 8 to 22 carbon atoms and $X^-$ represents an inorganic or organic counterion. The glycine betaine amide component of the present compositions may include one or more glycine betaine amides of formula (I). In some embodiments, R may be a linear or branched aliphatic group. In some embodiments, R may be a linear aliphatic group. In some embodiments, R may be a $C_8$-$C_{22}$ linear aliphatic group. In some embodiments, R may be an aliphatic group having 10 to 18 carbon atoms. In some embodiments, R may be a linear primary aliphatic group having 8 to 18 carbon atoms, e.g. an R group that is part of a fatty amine compound. In another embodiment, R may be an aliphatic group having 10 to 16 carbon atoms, such as the R group present in a $C_{10}$-$C_{16}$ linear primary alkyl amine. In some embodiments, R may be an alkyl and/or an alkenyl group. The R group may be a $C_8$, $C_{10}$, $C_{12}$, $C_{14}$, $C_{16}$, and/or $C_{18}$ aliphatic group, e.g., a $C_8$, $C_{10}$, $C_{12}$, $C_{14}$, $C_{16}$, and/or $C_{18}$ linear primary alkyl and/or alkenyl group. In some embodiments, R may be a $C_8$, $C_{10}$, $C_{12}$, $C_{14}$, $C_{16}$ and/or $C_{18}$ alkyl group and/or an oleic group. In some embodiments, R may be a $C_{10}$, $C_{12}$, $C_{14}$, and/or $C_{16}$ aliphatic group. In some embodiments, R may be a $C_{10}$, $C_{12}$, $C_{14}$, and/or $C_{16}$ alkyl group. In some embodiments, R may be a lauric, mystric, palmitic, stearic, and/or oleic group. In certain embodiments, R may include a lauric and/or mystric group. In some embodiments, R may be a $C_{12}$ and/or $C_{14}$ alkyl and/or alkenyl group. Examples of suitable inorganic or organic anions which may be present as the counterion, $X^-$, include halide, carboxylic acid, alkylcarbonate, alkylsulfonate, arylsulfonate, alkylsulfate, sulfate, nitrate, phosphate, and phosphite anions. In many embodiments, $X^-$ represents an alkanesulphonate anion, such as a methanesulphonate anion.

In some embodiments, $X^-$ represents $Cl^-$, $Br^-$, $I^-$, $CH_3CO_2^-$, $CH_3CH(OH)CO_2^-$, $CH_3SO_3^-$, $ArSO_3^-$, $CH_3C_6H_4SO_3^-$, $CH_3OSO_3^-$, $H_2PO_4^-$, and/or $H_2PO_3^-$ anion. $X^-$ may be a halide or alkylsulfonate anion. In some embodiments, $X^-$ may be a chloride or methanesulfonate anion. As noted above, in glycine betaine amides derived from natural glycine betaine, $X^-$ may commonly be a methane sulfonate anion.

In many embodiments of the present compositions, the glycine betaine amide may be present in combination with an aliphatic amine (i.e., $RNH_2$) and/or salt thereof, wherein R is as defined above. Often, aliphatic amine may be present as an unreacted starting material of the reaction used to produce the glycine betaine amide. In such cases, the "R group" of the aliphatic amine is commonly the same as the "R group" of the glycine betaine amide. The weight ratio of the glycine betaine amide to the aliphatic amine in the compositions may be about 10:1 to 1:5, more commonly about 10:1 to 1:2. In some embodiments, the weight ratio of the glycine betaine amide to the aliphatic amine may be about 5:1 to 1:1. In some embodiments, the glycine betaine amide may include a mixture of glycine betaine amides having R groups with 12 to 14 carbon atoms. The composition may also include one or more fatty amines with 12 to 14 carbon atoms and/or salt thereof in combination with such a glycine betaine amide. In some embodiments, the glycine betaine amide component may be an unpurified reaction product, which also includes glycine betaine and/or salt thereof. In some embodiments, such an unpurified reaction product may include methanesulfonic acid and/or salt thereof. In some embodiments, the unpurified reaction product may include methanesulfonic acid and/or glycine betaine and/or a salt thereof. In addition to the glycine betaine amide, in some embodiments the composition may further include an aliphatic alcohol, e.g. aliphatic $C_8$-$C_{22}$ alcohol, more typically a $C_8$-$C_{15}$ alcohol such as a $C_8$-$C_{14}$ fatty alcohol. For example, the composition may include a linear aliphatic $C_8$-$C_{18}$ alcohol in combination with the glycine betaine amide. In some embodiments, the composition may include a glycine betaine amide of Formula I, wherein $X^-$ represents a methanesulfonate anion and the R group includes a lauric and/or myristic group. In some embodiments, the composition may include about 0.1 wt. % to 15 wt. %, about 0.1 wt. % to 5, or more preferably about 0.1 wt. % to 3 wt. % of the glycine betaine amide. In some embodiments, the composition may include about 0.1 wt. % to 2 wt. % of the glycine betaine amide.

In some embodiments, in addition to the glycine betaine amide, the composition may also include a glycine betaine ester, e.g. a glycine betaine ester of formula (II):

$$Me_3N^+—CH_2—C(O)—O—RX^- \quad (II)$$

wherein R and $X^-$ are as defined above. In some embodiments, R may be an aliphatic group having 8 to 22 carbon atoms. In some embodiments, $X^-$ may be a methanesulfonate anion.

The polysaccharide thickener may include starch, modified starch, agar, carrageenan, pectin, alginate, cellulose, and/or a cellulose derivative. In some embodiments, the polysaccharide thickener may include starch or a modified starch. In some embodiments, the polysaccharide thickener may include natural gum. Non-limiting examples of natural gum include agar, carob gum, guar gum, gellan gum, xanthan gum, and/or acacia gum. In some embodiments, the polysaccharide may desirably include xanthan gum and/or guar gum. In some embodiments, the composition may include about 0.1 to 5 wt. %, about 0.5 to 4 wt. %, or about 0.1 to 2 wt. % of one or more polysaccharide thickeners. For example, when the composition includes a natural gum as a thickener, the polysaccharide thickener may include about 0.1 to 1.5 wt. % and, more commonly about 0.2 to 1 wt. % xanthan gum and/or guar gum. When the composition includes starch and/or modified starch as a thickener, the composition may include about 2 to 4 wt. % of the polysaccharide thickener.

In some embodiments, composition may include other thickeners, such as rheology modifiers based on polyacrylates (including carbomers) and polyacrylamides; acrylamidomethylpropane sulfate including acryloyldimethyltaurates; PEG and polyol thickeners; cationic thickeners; cyclodextrin-based rheology modifiers; star polymers and dendrimers; polypeptide/protein thickeners; silicone thickeners; amphipathic polymers, synthetic associative thickeners, polymeric emulsifiers, gums from seaweed, gums produced by fermentation; chitin and derivatives and mineral thickeners. These other thickeners may be used in place of or in addition to the polysaccharide thickeners.

The acidifying agent may include mineral acid, such as hydrochloric acid, and/or one or more organic acids. For example, the acidifying agent may include an organic acid, such as lactic acid, glycolic acid, citric acid, acetic acid, malonic acid, succinic acid, tartaric acid gluconic acid, glutaric acid and/or methanesulfonic acid. In some embodiments, the acidifying agent may include a carboxylic acid, e.g., one or more hydroxycarboxylic acids. Non-limiting examples of suitable hydroxycarboxylic acids include lactic acid, citric acid, tartaric acid and gluconic acid. In some embodiments, the acidifying agent may include mineral acid, such as hydrochloric acid. In some embodiments, the acidifying agent may include methanesulfonic acid. In some embodiments, the acidifying agent may include lactic acid and/or citric acid. In some embodiments, the acidifying agent may include lactic acid. In some embodiments, the composition may include about 0.1 wt. % to 10 wt. %, about 0.5 wt. % to 10 wt. %, about 1 wt. % to 10 wt. %, or about 0.5 wt. % to 5 wt. % of one or more acidifying agents. In some embodiments, the composition may include at least about 1 wt. % of a mineral acid, such as hydrochloric acid, and may commonly include up to about 10 wt. % of the mineral acid (e.g., hydrochloric acid). In some embodiments, the composition may include at least about 1 wt. % and commonly about 1 to 5 wt. % of an organic acid. For example, the composition may include about 1 to 5 wt. % of an organic acid, which includes lactic acid, glycolic acid, citric acid, acetic acid, malonic acid, succinic acid, tartaric acid gluconic acid, glutaric acid and/or methanesulfonic acid. In many embodiments, the composition may include about 1 to 5 wt. % lactic acid. In other embodiments, the composition may include about 1 to 5 wt. % citric acid.

The cleaning composition may include one or more additional surfactants that are different from the glycine betaine amide selected from nonionic, anionic, cationic, zwitterionic, and/or amphoteric surfactants and mixtures thereof. In some embodiments, the composition may include one or more anionic and/or cationic surfactants. In some embodiments, the surfactants may be detersive surfactants. In some embodiments, the composition may include up to about 5 wt. %, about 0.1 wt. % to 3 wt. %, or about 0.1 to 2 wt. % of the surfactant.

The surfactants may include one or more alkoxylated alcohols. The alkoxylated alcohol may include one or more ethoxylated alcohols. Ethoxylated alcohols may be linear or branched. In some embodiments, the ethoxylated alcohol may include a $C_8$-$C_{16}$ alcohol having an average of 2 to 20 ethylene oxide units, more commonly 2 to 12 ethylene oxide units. Typically, when present, the ethoxylated alcohol includes a $C_9$-$C_{15}$ linear and/or branched alcohol having an average of 5 to 12 ethylene oxide units. A non-limiting example is Genapol® X-100 (available from CLARIANT), which is a branched iso-$C_{13}$ alcohol ethoxylate having an average of 10 ethylene oxide units. Other ethoxylated alcohols that may be present in the cleaning compositions as a nonionic surfactant include linear or branched ethoxylated alcohols including a $C_5$-$C_{15}$ alcohol having an average of 4 to 12 ethylene oxide units. Nonlimiting examples include Tomadol® 91-6-a $C_9$-$C_{11}$ ethoxylated alcohol having an average of 6 ethylene oxide units (available from Air Products and Chemicals, Inc.), LUTENSOL® AO-8—a synthetic $C_{13}$-$C_{15}$ ethoxylated oxo alcohol having an average of 8 ethylene oxide units (available from BASF), Genapol® LA 070S—an ethoxylated lauryl alcohol having an average of 7 ethylene oxide units (available from CLARIANT), and TERGITOL™ 15-S-7, a branched secondary ethoxylated alcohol with 7 ethylene oxide units (available from DOW Chemical). Other examples of suitable ethoxylated linear alcohols include ethoxylated linear alcohols having a $C_{10}$-$C_{15}$ n-alkyl group, e.g., having an average of 2 to 12 ethylene oxide units. Nonlimiting examples include LUTENSOL® TDA 10 (available from BASF)—an ethoxylated tridecyl alcohol having an average of 10 EO groups. Triglyceride derivatives such as ethoxylated triglycerides having an average of 2 to 10 ethylene oxide units may also be used (e.g., such compounds are available from BASF or Rhodia).

Other nonionic surfactants which may be present include, but are not limited to, secondary ethoxylated alcohols, such as $C_{11}$-$C_{15}$ secondary ethoxylated alcohols. Secondary ethoxylated alcohols suitable for use are sold under the tradename TERGITOL® (available from Dow Chemical). For example TERGITOL® 15-S, more particularly TERGI- TOL® 15-S-12 is a $C_{11}$-$C_{15}$ secondary ethoxylate alcohol having an average of about 12 ethylene oxide groups.

Additional suitable nonionic surfactants include linear alkyl amine oxides. Typical linear alkyl amine oxides include water-soluble amine oxides of the formula $R^1$—N($R^2$)($R^3$)O where $R^1$ is typically a $C_8$-$C_{18}$ alkyl moiety and the $R^2$ and $R^3$ moieties are typically selected from the group consisting of hydrogen, $C_1$-$C_3$ alkyl groups, and $C_1$-$C_3$ hydroxyalkyl groups. Quite often, $R^1$ is a $C_8$-$C_{18}$ n-alkyl and $R^2$ and $R^3$ are methyl, ethyl, propyl, isopropyl, 2-hydroxyethyl, 2-hydroxypropyl, and/or 3-hydroxypropyl. The linear amine oxide surfactants in particular may include linear $C_{10}$-$C_{18}$ alkyl dimethyl amine oxides and linear $C_8$-$C_{12}$ alkoxy ethyl di(hydroxyethyl) amine oxides. Particularly suitable amine oxides include linear $C_{10}$, linear $C_{10}$-$C_{12}$, and linear $C_{12}$-$C_{14}$ alkyl dimethyl amine oxides. Other examples of amine oxide nonionic surfactants include alkyl amidopropyl amine oxides, such as lauryl/myristyl amidopropyl amine oxides (e.g., lauryl/myristyl amidopropyl dimethylamine oxide).

In some embodiments, the cleaning composition may include one or more bases. In some embodiments, the base may be an organic base such as an alkylamine including triethylamine and heterocyclic amines such as pyrrole, pyridine, and piperdine. In some embodiments, the base may be an inorganic base including alkali metals and alkaline earth metal bases such as NaOH, LiOH, KOH, $Mg(OH)_2$, and $Ca(OH)_2$. The cleaning composition may include up to about 5 wt. % of one or more bases. In some embodiments, the cleaning composition may include about 0.001 wt. % to 3 wt. %, about 0.01 wt. % to 1 wt. %, or more preferably about 0.05 wt. % to 0.5 wt. % of one or more bases.

The cleaning composition may include other ingredients including adjuvants. As used herein, adjuvants include components or agents, such as additional functional materials. In some embodiments, the functional materials may be included to provide desired properties and functionalities to the cleaning composition. For the purpose of this application, the term "functional materials" include a material that when dispersed or dissolved in a concentrate and/or use solution, such as an aqueous solution, provides a beneficial property in a particular use. The present compositions may optionally include other soil-digesting components, surfactants, disinfectants, detergent fillers, sanitizers, acidulants, complexing agents, biocides and/or antimicrobial agents, corrosion inhibitors, anti-redeposition agents, foam inhibitors, opacifying agents such as titanium dioxide, dyes, bleaching agents (e.g., hydrogen peroxide and other peroxides), enzymes, enzyme stabilizing systems, builders, thickening or gelling agents, wetting agents, dispersants, stabilizing agents, dispersant polymers, cleaning compounds, pH adjusting agents (acids and alkaline agents), stain preventers, and/or fragrances. In some embodiments, the composition may include one or more of an antimicrobial agent, a bleaching agent, a fragrance, and/or dye component. In some embodiments, the composition may include up to about 1 wt. %, about 0.05 to 0.5 wt. %, or about 0.1 to 0.3 wt. % of a fragrance component. In some embodiments, the composition may include up to about 1 wt. %, about 0.001 to 0.5 wt. %, or about 0.01 to about 0.1 wt. % of one or more dye components.

In some embodiments, the composition may include: about 0.1-3 wt. % of the glycine betaine amide; about 0.5-10 wt. % of the acidifying agent; about 0.5-5 wt. % of the polysaccharide thickener; and at least about 85 wt. %, more commonly at least about 90 wt. % water.

In some embodiments, the composition may include: (a) about 0.1-3 wt. % of the glycine betaine amide; (b) about 0.5-5 wt. % of the acidifying agent; (c) about 0.5-3 wt. % of the polysaccharide thickener; and (d) at least about 90 wt. %, more commonly at least about 95 wt. % water.

In some embodiments, the composition may include: about 0.1-3 wt. % of the glycine betaine amide; about 0.5-5 wt. % of an acidifying agent, which may include a hydroxycarboxylic acid, e.g. lactic and/or citric acid, and/or acetic acid; about 0.1-1 wt. % of the polysaccharide thickener, which may include a natural gum; and at least about 90 wt. %, more commonly at least about 95 wt. % water.

In some embodiments, the composition may include: about 0.1-3 wt. % of the glycine betaine amide; about 0.5-10 wt. % of the acidifying agent, which may include a mineral acid; about 0.1-1 wt. % of the polysaccharide thickener, which may include a natural gum; and at least about 90 wt. %, more commonly at least about 95 wt. % water.

In some embodiments, the composition may include: about 0.1-3 wt. % of the glycine betaine amide; about 0.5-10 wt. % of the acidifying agent, which may include a mineral acid; about 0.5-4 wt. % of the polysaccharide thickener, which may include starch and/or a modified starch; and at least about 90 wt. %, more commonly at least about 95 wt. % water.

In some embodiments, the composition may include: about 0.1-3 wt. % of the glycine betaine amide; about 0.5-5 wt. % of the acidifying agent, which may include a hydroxycarboxylic acid, e.g. lactic and/or citric acid; about 0.5-4 wt. % of the polysaccharide thickener, which may include starch and/or a modified starch; and at least about 90 wt. %, more commonly at least about 95 wt. % water.

As used herein, "composition" refers to any liquid, foam, solid, gel, and/or paste substance having more than one component.

As used herein, "fragrance" refers to any perfume, odor-eliminator, odor masking agent, the like, and combinations thereof. In some embodiments, a fragrance is any substance which may have an effect on a consumer, or user's, olfactory senses.

As used herein, "wt. %" refers to the weight percentage of an ingredient in the total formula. For example, an off-the-shelf commercial composition of Formula X may only contain 70% active ingredient X. Thus, 10 g of the off-the-shelf composition only contains 7 g of X. If 10 g of the off-the-shelf composition is added to 90 g of other ingredients, the wt. % of X in the final formula is thus only 7%.

As used herein, "hard surface" refers to any porous and/or non-porous surface. In one embodiment, a hard surface may be selected from the group consisting of: ceramic, glass, metal, polymer, stone, and combinations thereof. For the purposes of this application, a hard surface does not include silicon wafers and/or other semiconductor substrate materials. Nonlimiting examples of ceramic surfaces include: toilet bowl, sink, shower, tile, the like, and combinations thereof. A non-limiting example of a glass surfaces includes: window and the like. Nonlimiting examples of metal surfaces include: drain pipe, sink, the like. Nonlimiting examples of a polymeric surface includes: PVC piping, fiberglass, acrylic, Corian®, the like. A non-limiting example of a stone hard surface includes: granite, marble, and the like.

A hard surface may be any shape, size, or have any orientation that is suitable for its desired purpose. In one non-limiting example, a hard surface may be oriented in a vertical configuration. In another non-limiting example, a hard surface may be the surface of a curved surface, such as a ceramic toilet bowl. In yet another non-limiting example, a hard surface may be the inside of a pipe, which has vertical and horizontal elements, and also may have curved elements. It is thought that the shape, size and/or orientation of the hard surface will not affect the compositions of the present invention, because of the unexpectedly strong transport properties of the compositions under the conditions described infra.

As used herein, "surfactant" refers to any agent that lowers the surface tension of a liquid, for example water. Exemplary surfactants which may be suitable for use with the present invention are described herein. In one embodiment, surfactants may be selected from the group consisting of anionic, non-ionic, cationic, amphoteric, zwitterionic, and combinations thereof.

As used herein, "viscosity" refers to the resistance to gradual deformation by shear stress or tensile stress of a composition. The rheology profiles (determined at shear rates from 1-100 $sec^{-1}$) of all viscous formula were measured at 25° C. using a TA AR 2000 rheometer equipped with a 4 cm stainless steel parallel plate and Peltier plate at a shear of 1 to 100 $sec^{-1}$. In other instances, viscosity values were measured using a Brookfield rheometer at 25° C. using a spindle of 2 and 12 RPM.

EXAMPLES

The following examples are intended to more specifically illustrate the present cleaning compositions according to various embodiments described above. These examples should in no way be construed as limiting the scope of the present technology.

A number of exemplary formulations of the present cleaning compositions were prepared and are presented in Tables 1-12 below. For all formulations, the balance of the formulation was water. The ability of the test formulations to remove lime scale and organic soil from a hard surface was determined using the procedures described below.

Lime Scale Removal Test

The effectiveness of the present cleaning compositions to remove lime scale from a hard surface was determined using the following procedure. Marble chips were used to simulate lime scale. Testing procedures are designed to provide a simulation of conditions that would commonly be found in toilets containing lime scale. The time required to complete this test is 48 hours. Total time required for test, including preparation of materials is 3 days. Approximately 5 grams of marble chips are rinsed with Deionized water for 3 minutes and drained. The marble chips are baked in oven set at 40+/−2° C. for 48 hours and cool at room conditions for 2 hours+/−15 minutes. The formulation being tested (100 g of per 5.00 g of marble chips) are stored at room conditions in contact with the marble chips undisturbed for eighteen hours. The marble chips are then drained and rinsed under deionized water for 30 seconds to remove excess formula. The marble chips are then dried again in an oven at 40°+/−2° C. for 48 hours, cooled to room temperature (~2 hours+/−15 min) and weighed. The percentage weight loss is calculated according to the formula below and report as % lime scale removal. The value reported is an average of 3 separate results.

$$(W_i - W_f \times 100)/W_i.$$

where; $W_i$=initial weight of marble chips; $W_f$=final weight of marble chips.

Organic Soil Removal Test

The effectiveness of the present cleaning compositions to remove organic soil from a hard surface was determined using the following procedure. To measure the ability of a liquid toilet bowl cleaner to remove organic stains, colorimeter readings (L, a, b values) are taken on clean ceramic tiles through a piece of glass that is mounted on a jig. A silkscreen is used to apply the organic soil to the ceramic tiles. Colorimeter readings are taken immediately after the organic soil is applied (organic soil should be wet). Product is allowed to dwell on the surface of the soiled tile for 1 minute. A scrubber with a brush attachment is then used to scrub the tile three times (3 passes). Cleaning efficacy or percent soil removed is determined by using the measured colorimeter readings before and after treatment with the liquid toilet bowl cleaner in the equation below.

$$\text{Percent Soil Removal} = 100 * \left( \frac{\sqrt{((L_s - L_c)^2 + (a_s - a_c)^2 + (b_s - b_c)^2)}}{\sqrt{((L_s - L_n)^2 + (a_s - a_n)^2 + (b_s - b_n)^2)}} \right)$$

where s=soiled tile reading; n=non-soiled tile reading; and c=cleaned tile reading.

Example 1

Several exemplary formulations of the cleaning compositions were prepared and are presented in Tables 1-5 below. For all formulations, the balance of the formulation was water. Table 1 includes a benchmark formulation that does not include glycine betaine amides and varying formulations with a crude glycine betaine amide ($C_{12}$ or $C_{18}$) and hydrochloric acid or lactic acid. Table 1 demonstrates that the formulations of the present compositions are 1.5 to nearly 2.5 times better at removing lime scale and considerably better at removing organic soil compared to a standard benchmark cleaning formulation.

TABLE 1

| | Standard | Formula 1 | Formula 2 | Formula 3 | Formula 4 |
|---|---|---|---|---|---|
| | | | Surfactant | | |
| | 0.8% ROH-EO (Lutensol A08) 0.55% SLES | 0.4 wt. % $C_{12}$-GB Amide (Cr) * | 0.4 wt. % $C_{18:1}$-GB Amide (Cr) ** | 0.4 wt. % $C_{12}$-GB Amide (Cr) ** | 0.4 wt. % $C_{18:1}$-GB Amide (Cr) ** |
| Acidifying Agent | 2.02 wt. % lactic acid | 1.9 wt. % lactic acid | 1.9 wt. % lactic acid | 1.9 wt. % HCl | 1.88 wt. % HCl |
| Polysaccharide Thickener | 0.43 wt. % xanthan gum | 0.5 wt. % guar gum | 0.5 wt. % guar gum | 0.5 wt. % guar gum | 0.5 wt. % guar gum |
| NaOH | 0.010 wt. % | — | — | — | — |

TABLE 1-continued

| | Standard | Formula 1 | Formula 2 | Formula 3 | Formula 4 |
|---|---|---|---|---|---|
| | | | Surfactant | | |
| | 0.8% ROH-EO (Lutensol A08) 0.55% SLES | 0.4 wt. % $C_{12}$-GB Amide (Cr) * | 0.4 wt. % $C_{18:1}$-GB Amide (Cr) ** | 0.4 wt. % $C_{12}$-GB Amide (Cr) ** | 0.4 wt. % $C_{18:1}$-GB Amide (Cr) ** |
| Fragrance | 0.18 wt. % | 0.18 wt. % | 0.18 wt. % | 0.18 wt. % | 0.18 wt. % |
| Dye | 0.005 wt. % | 0.005 wt. % | 0.005 wt. % | 0.005 wt. % | 0.005 wt. % |
| pH | 2.23 | 2.1 | 2.1 | 0.84 | 0.84 |
| Limescale removal (%) | 8 | 12 | 13 | 19 | 18 |
| Organic soil removal (%) | 65 | 82 | 80 | 82 | 85 |

* = crude $Me_3N^+$—$CH_2$—C(O)—NH—$C_{12}$-alkyl amide methanesulfonate
** = crude $Me_3N^+$—$CH_2$—C(O)—NH—$C_{18}$-alkyl amide methanesulfonate

Example 2

Table 2 includes several formulations that demonstrate that the present compositions with lactic acid are typically better at removing lime scale and organic soil compared to a standard benchmark formulation.

TABLE 2

| | Formula 5 | Formula 6 | Formula 7 | Formula 8 | Formula 9 |
|---|---|---|---|---|---|
| $C_{12}$-GB Amide (Cr) * (wt. %) | 0.25 | 0.40 | 0.41 | 0.41 | 0.41 |
| Guar gum (wt. %) | 0.75 | 1.00 | 0.50 | 0.75 | 0.75 |
| Lactic acid (wt %) | 1.85 | 1.90 | 1.91 | 1.51 | 1.82 |
| Lime scale removed (%) | 10 | 9.7 | 12 | 7.3 | 10 |
| Organic soil removed (%) | 79 | 82 | 82 | 84 | 81 |

* = crude $Me_3N^+$—$CH_2$—C(O)—NH—$C_{12}$-alkyl amide methanesulfonate

Example 3

Figure 4:
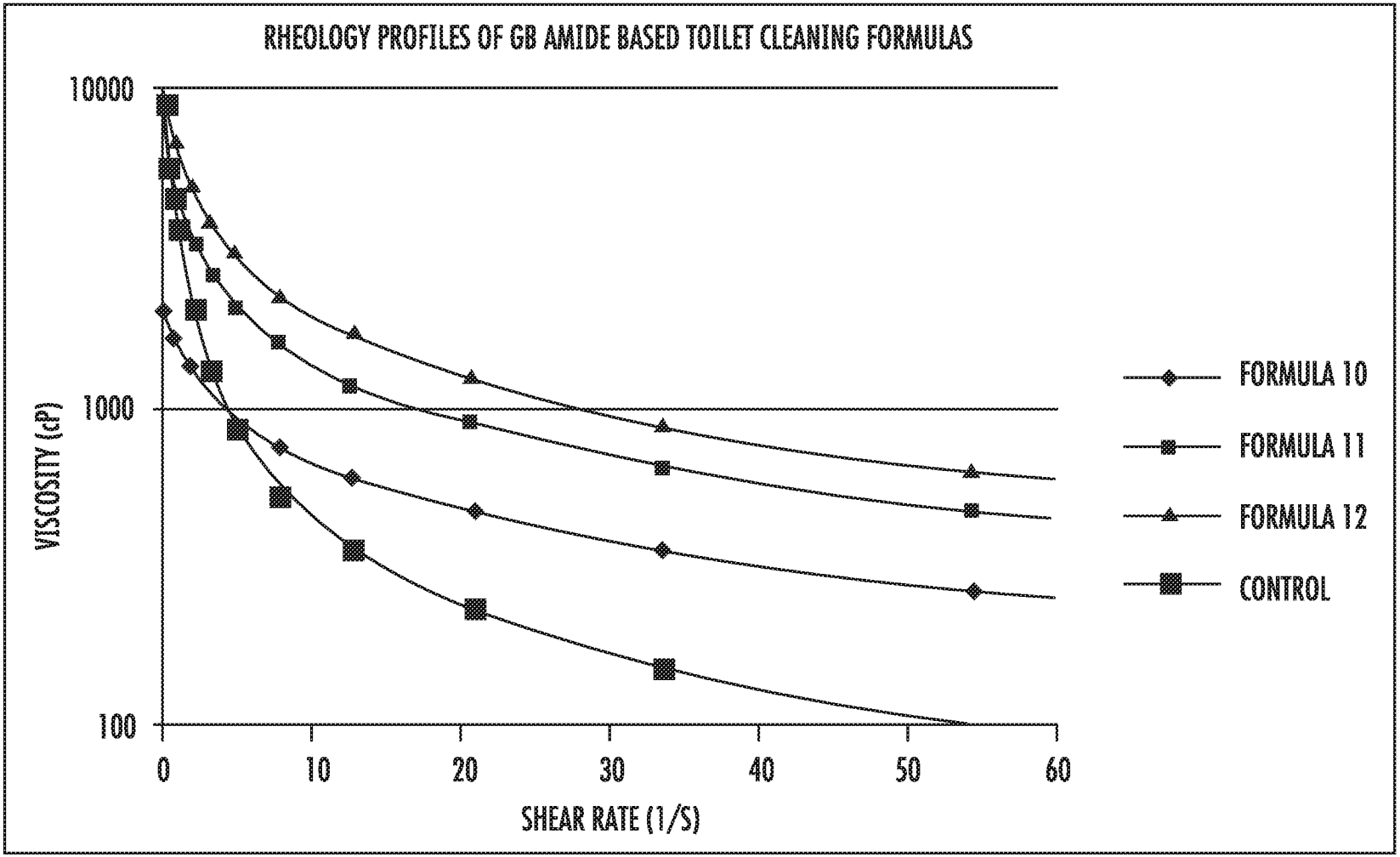
FIG. 4 is a graph illustrating the rheology profiles of three illustrative examples of the present cleaning compositions (containing either 0.4, 0.8 or 1 wt. % of a crude C12 GB Amide formulated with 0.7-1 wt. % Guar Gum) in comparison to a standard benchmark cleaning product, which contains a combination of a natural gum (xanthan gum) with an ethoxylated oxo alcohol and sodium lauryl ether sulfate.

Table 3 includes several formulations of the present compositions. The three formulations exemplifying the present cleaning products (containing a combination of GB Amide and natural gum) have rheology profiles which exhibit less shear thinning than observed with the standard benchmark cleaning product (which contains a combination of a xanthan gum with an ethoxylated oxo alcohol and sodium lauryl ether sulfate). As shown in FIG. 4, the formulations demonstrate a yield stress or initial viscosity similar to the benchmark formulation, but exhibit a much greater resistance to shear thinning. For example, as shown in FIG. 4, the three formulations have a 10/50 shear rate ratio between about 2:1 and 3:1 compared to the benchmark cleaning formulation with a ratio of about 4:1. Particularly notable is that Formulas 11 and 12 have viscosities in excess of 250 cPs even when measured at a shear rate ratio of 50.

TABLE 3

| | Formula 10 | Formula 11 | Formula 12 |
|---|---|---|---|
| $C_{12}$-GB Amide (Cr)* (wt. %) | 0.4 | 0.8 | 1.0 |

TABLE 3-continued

| | Formula 10 | Formula 11 | Formula 12 |
|---|---|---|---|
| Guar Gum (wt. %) | 0.7 | 0.9 | 1.0 |
| Lactic acid (wt. %) | 2.02 | 2.02 | 2.02 |
| Dye (wt. %) | 0.027 | 0.027 | 0.027 |
| Takasago RW-4173 (fragrance) (wt. %) | 0.2 | 0.2 | 0.2 |
| Viscosity at $10^{-1}$ at 25° C. | 682 | 1406 | 1980 |
| Viscosity at $50^{-1}$ at 25° C. | 278 | 500 | 664 |
| 10/50 Shear Rate Ratio | 2.45 | 2.81 | 2.98 |

*= crude $Me_3N^+$—$CH_2$—C(O)—NH—$C_{12}$ alkyl methanesulfonate

Example 4

Table 4 includes formulations with starch as the polysaccharide thickener and demonstrates that various polysaccharide thickeners provide compositions with a greater resistance to shear thinning compared to the benchmark formulation.

TABLE 4

| | Formula 13 | Formula 14 | Benchmark |
|---|---|---|---|
| $C_{12}$-GB Amide (Cr) * (wt. %) | 0.32 | 0.32 | 1.35** |
| Starch (wt. %) | 2.14 | 2.76 | 0.43 (xanthan gum) |
| Lactic acid (wt %) | 1.78 | 1.67 | 2.02 |
| pH | 2.39 | 2.11 | 2.23 |
| Viscosity (cP) | 1247 | 1175 | — |

* crude $Me_3N^+$—$CH_2$—C(O)—NH—$C_{12}$-alkyl amide methanesulfonate
**0.8% ROH-EO {Lutensol A08} + 0.55% Na lauryl ether sulfate {"ROH-EO/SLES"}

Table 4 includes formulations of the present compositions with various polysaccharide thickeners. The formulations exhibit a much greater resistance to shear thinning compared to a benchmark formulation. For example, at shear rates of 10 and 50, the present cleaning formulations have a 10/50 shear rate ratio between about 1.6 and 2 compared to the benchmark formulation with a 10/50 shear rate ratio of about 4:1.

Example 5

Table 5 lists a number of examples of formulations of the present composition which include lactic acid together with varying levels of a crude $Me_3N^+$—$CH_2$—C(O)—NH—$C_{18:}$ $_{1}$-alkyl amide methanesulfonate (C18:1 GB Amide Crude" or "Oleic GB Amide Crude") and varying levels of guar gum. The crude C18:1 GB Amide contained 68 wt. % C18:1 GB Amide, 5 wt. % glycine betaine, and 27 wt. % of the methanesulfonate salt of a C18:1 fatty amine.

TABLE 5

| Property | Component | | | |
|---|---|---|---|---|
| | Formula 19 | Formula 20 | Formula 21 | Benchmark |
| $C_{18:1}$-GB Amide (Cr)* (wt. %) | 0.40 | 0.40 | 0.41 | 1.35** |
| Guar gum (wt. %) | 0.5 | 1.0 | 0.5 | 0.43 (xanthan gum) |
| Lactic acid (wt %) | 1.92 | 1.9 | 1.88 (HCl) | 2.02 |
| pH | 2.07 | 2.1 | 0.84 | 2.23 |
| Lime scale removed (%) | 11.9 | 8.2 | 17.8 | 8.6 |
| Organic soil removed (%) | 79 | 80 | 85 | 66 |

*crude $Me_3N^+$—$CH_2$—C(O)—NH—$C_{18:1}$-alkyl amide methanesulfonate
**0.8% ROH-EO {Lutensol A08} + 0.55% Na lauryl ether sulfate {"ROH-EO/SLES"}

Example 6

Table 6 lists a number of examples of formulations of the present composition which include lactic acid together with varying levels of a crude $Me_3N^+$—$CH_2$—C(O)—NH—$C_{12}$-alkyl amide methanesulfonate (C12 GB Amide Crude) and varying levels of guar gum. The crude C12 GB Amide contained 68 wt. % C12 GB Amide, 3 wt. % glycine betaine, and 29 wt. % of the methanesulfonate salt of lauric amine.

TABLE 6

| Property | Component | | | |
|---|---|---|---|---|
| | Formula 22 | Formula 23 | Formula 24 | Benchmark |
| $C_{12}$-GB Amide (Cr)* (wt. %) | 0.25 | 0.4 | 1.35 | 1.35** |
| Guar gum (wt. %) | 0.75 | 1.0 | 1.0 | 0.43 (xanthan gum) |
| Lactic acid (wt %) | 1.85 | 1.9 | 1.9 | 2.02 |
| pH | 2.39 | 2.13 | 2.09 | 2.23 |
| Lime scale removed (%) | 10.1 | 9.7 | 8.1 | 8.6 |
| Organic soil removed (%) | 79 | 82 | 76 | 66 |

*crude $Me_3N^+$—$CH_2$—C(O)—NH—$C_{12}$-alkyl amide methanesulfonate (C12 GB Amide Crude"or "Lauric GB Amide Crude")
**0.8% ROH-EO {Lutensol A08} + 0.55% Na lauryl ether sulfate {"ROH-EO/SLES"}

Table 7 lists a summary of the cleaning efficiency of various GB C12 Amide-based MTBC compositions with lactic acid and guar gum.

TABLE 7

| Wt % C12 GB Amide Crude | Wt % Lactic Acid | Wt % Guar Gum | % Lime scale Removed | Organic Soil Removed |
|---|---|---|---|---|
| 0.25 | 1.82 | 0.75 | 10.1 | 79.1 |
| 0.4 | 1.9 | 1 | 9.7 | 81.6 |
| 0.41 | 1.82 | 0.75 | 10.1 | 81.2 |

TABLE 7-continued

| Wt % C12 GB Amide Crude | Wt % Lactic Acid | Wt % Guar Gum | % Lime scale Removed | Organic Soil Removed |
|---|---|---|---|---|
| 0.41 | 1.91 | 0.5 | 11.7 | 81.68 |
| 1.35 | 1.9 | 1 | 8.11 | 75.6 |
| 1.35* | 2.02 | 0.43* | 8.6 | 65.5 |

*Benchmark with Lutensol A08/SLES surfactant and xanthan gum thickener

Example 7

Table 8 lists a number of examples of formulations of the present composition which include hydrochloric acid together with varying levels of a crude $Me_3N^+$—$CH_2$—C(O)—NH—$C_{12}$-alkyl amide methanesulfonate (C12 GB Amide Crude) and varying levels of starch. The crude C12 GB Amide contained 68 wt. % C12 GB Amide, 3 wt. % glycine betaine, and 29 wt. % of the methanesulfonate salt of lauric amine.

TABLE 8

| Property | Component | | | |
|---|---|---|---|---|
| | Formula 25 | Formula 26 | Formula 27 | Benchmark |
| $C_{12}$-GB Amide (Cr)* (wt. %) | 0.32 | 1.0 | 3 | 1.35** |
| Starch (wt. %) | 3 | 2.3 | 2.3 | 0.43 {xanthan gum} |
| Lactic acid (wt. %) | 0.9 | 0.9 | 0.9 | 2.02 |
| pH | 2.13 | 2.56 | 2.56 | 2.23 |
| Lime scale removed (%) | 20.3 | 5.3 | 10.1 | 8.6 |
| Organic soil removed (%) | 77 | — | — | 66 |

*crude $Me_3N^+$—$CH_2$—C(O)—NH—$C_{12}$-alkyl amide methanesulfonate (C12 GB Amide Crude" or "Lauric GB Amide Crude")
**0.8% ROH-EO {Lutensol A08} + 0.55% Na lauryl ether sulfate {"ROH-EO/SLES"}

Example 8

Table 9 lists a number of examples of formulations of the present composition which include hydrochloric acid together with varying levels of a crude $Me_3N^+$—$CH_2$—C(O)—NH—$C_{12}$-alkyl amide methanesulfonate (C12 GB Amide Crude) and varying levels of guar gum. The crude C12 GB Amide contained 68 wt. % C12 GB Amide, 3 wt. % glycine betaine, and 29 wt. % of the methanesulfonate salt of lauric amine.

TABLE 9

| Property | Component | | | |
|---|---|---|---|---|
| | Formula 28 | Formula 29 | Formula 30 | Benchmark |
| $C_{12}$-GB Amide (Cr)* (wt. %) | 0.4 | 0.42 | 0.4 | 1.35** |
| Guar gum (wt. %) | 0.51 | 0.51 | 0.5 | 0.43 {xanthan gum} |
| HCL (wt. %) | 1.06 | 1.92 | 1.88 | 2.02 {lactic acid} |

TABLE 9-continued

| Property | Component | | | |
|---|---|---|---|---|
| | Formula 28 | Formula 29 | Formula 30 | Benchmark |
| pH | 1.06 | 0.86 | 0.84 | 2.23 |
| Lime scale removed (%) | 8.7 | 10.6 | 17.8 | 8.6 |
| Organic soil removed (%) | 77 | 84 | 85 | 66 |

*crude $Me_3N^+$—$CH_2$—C(O)—NH—$C_{12}$-alkyl amide methanesulfonate (C12 GB Amide Crude" or "Lauric GB Amide Crude")
**0.8% ROH-EO {Lutensol A08} + 0.55% Na lauryl ether sulfate {"ROH-EO/SLES"}

Example 9

Table 10 provides additional examples of MTBC compositions that use various GB Amide surfactants in combination with a cellulosic thickener (hydroxyethyl cellulose).

TABLE 10

| | |
|---|---|
| DEIONIZED WATER | Balance to 100% |
| Lactic Acid 80% | 2.0 |
| GB Amide (C8/C10, C12, C12/C14, or C18:1) | 0.40 |
| Thickening agent Hydroxyethyl cellulose (CELLOSIZE QP 100M-H) | 0.30 |
| Fragrance (TAKASAGO RJ 2507) | 0.20 |
| Chelating agent (XUS-40855.01 - HEIDA) | 0.20 |
| Dye (ACID BLUE #9, 100% powder) | 0.005 |

Example 10

Figure 5:
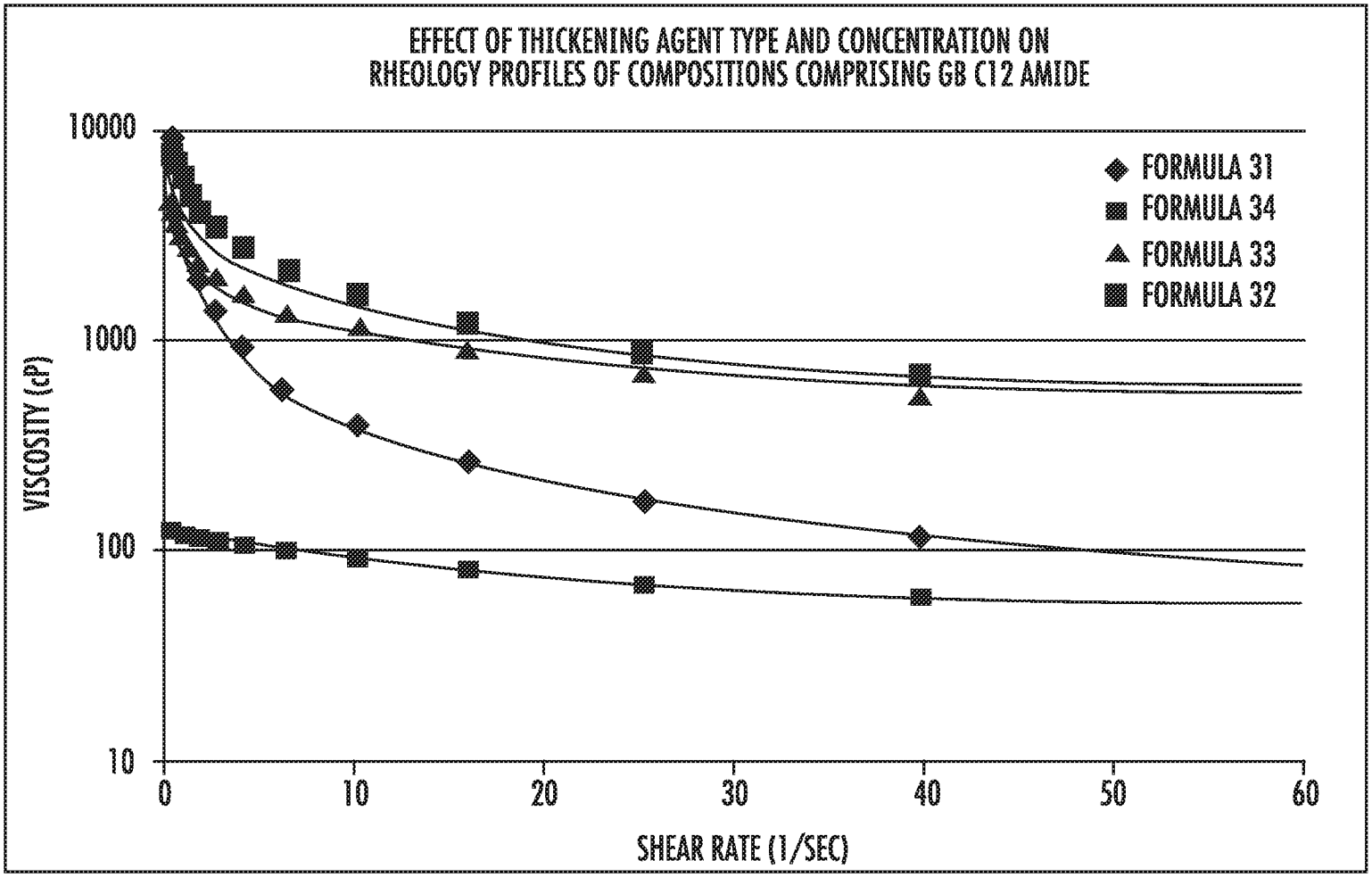
FIG. 5 is a graph illustrating the effect of thickening agent type and concentration on the rheology profiles a number of exemplary compositions containing a GB $C_{12}$ Amide derivative in combination with varying amounts of guar gum without the inclusion of any dye or fragrance in comparison with the benchmark formulation ("Kelzan Base").

Table 11 provides additional examples of MTBC compositions that use GB C12 Amide surfactants in combination with varying amounts of guar gum without the inclusion of any dye or fragrance. As shown in FIG. 5, the Formulations 33 and 34 demonstrate a yield stress or initial viscosity similar to the benchmark formulation ("Kelzan Base"), but exhibit a much greater resistance to shear thinning, with viscosities in approaching 1,000 cPs even when measured at a shear rate ratio of 50. Formulations 31, which contains a combination of GB C12 Amide and xanthan gum (as Kelzan AP), exhibits a viscosity profile similar to the benchmark formulation ("Kelzan Base").

TABLE 11

| | Formula 31 | Formula 32 | Formula 33 | Formula 34 |
|---|---|---|---|---|
| $C_{12}$-GB Amide (Cr)* (wt. %) | 2.7 | 2.7 | 2.7 | 2.7 |
| Polysaccharide Thickener (wt. %) | 0.4 {Xanthan gum as Kelzan AP} | 0.4 {Guar Gum} | 1.0 {Guar Gum} | 3.0 {Guar Gum} |
| Lactic acid (wt. %) | 2.3 | 2.3 | 2.3 | 2.3 |
| pH | 2.2 | 2.2 | 2.2 | 2.2 |

*crude $Me_3N^+$—$CH_2$—C(O)—NH—$C_{12}$ alkyl methanesulfonate

Example 11

Figure 2:
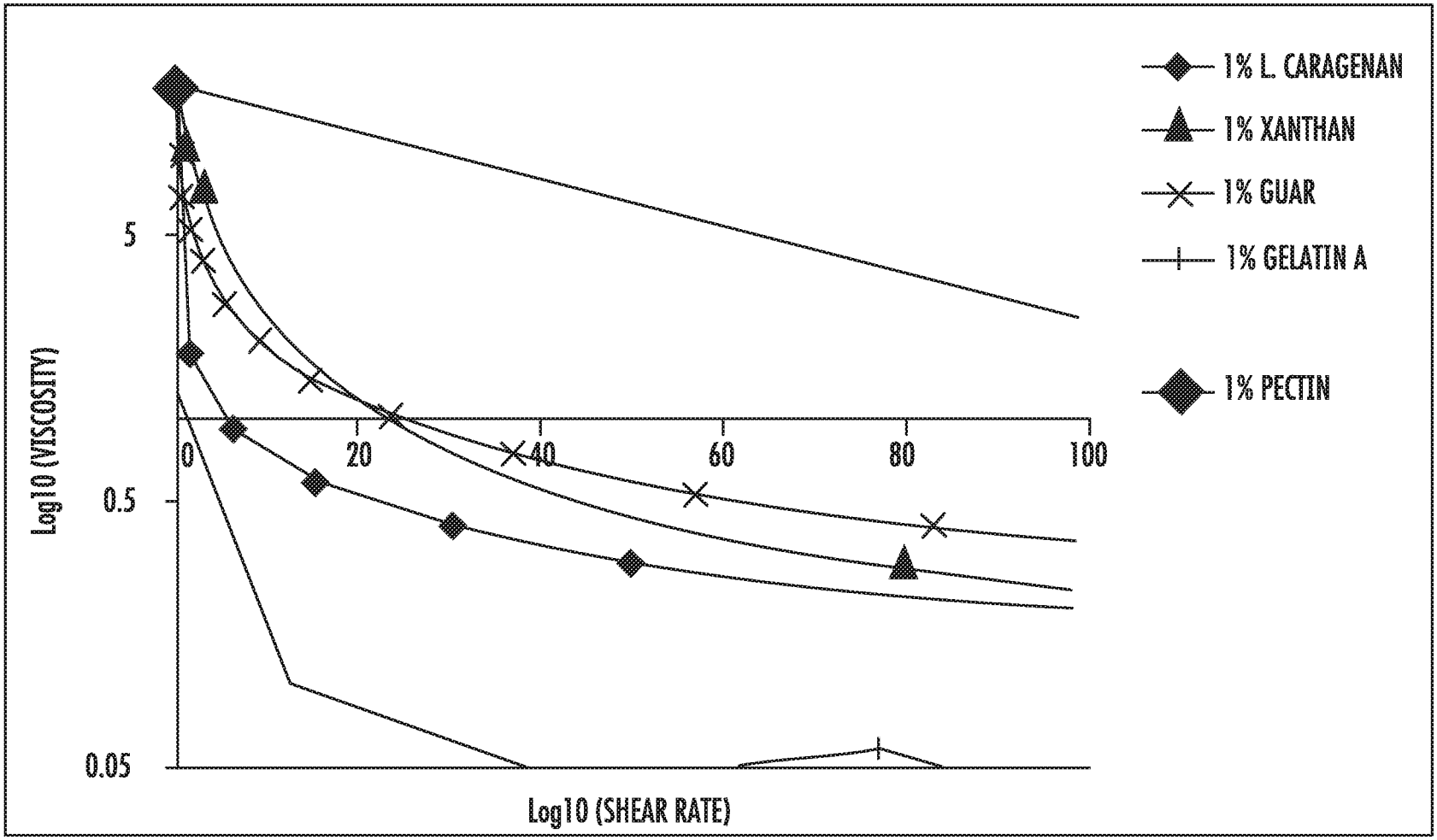
FIG. 2 is a graph illustrating the rheology profiles of a number of GB Amide-based MTBC compositions formulated with various thickening agents (1% carrageenan, 1% xanthan, 1% guar, or 1% gelatin A).
Figure 3:
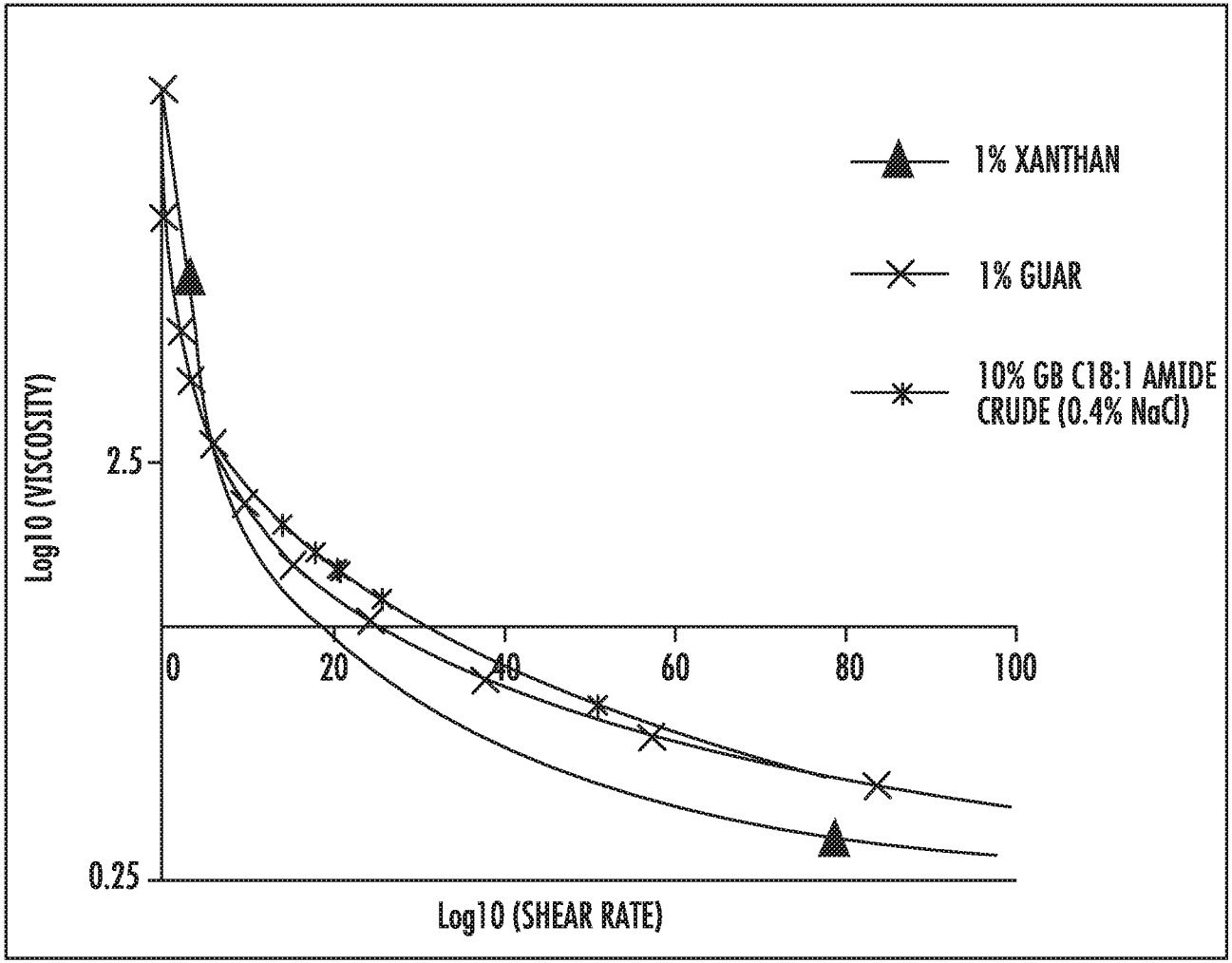
FIG. 3 is a graph illustrating the rheology profile of a GB Amide-based MTBC composition containing C18:1 GB Amide formulated with NaCl (0.4 wt. %) as the sole thickening agent in comparison with two MTBC compositions containing C12 GB Amide formulated with a natural gum thickening agent (1 wt. % xanthan gum or 1 wt. % guar gum).

GB Amide-based MTBC compositions were formulated with various thickening agents to study the effect of combinations on their rheology properties and profile. The compositions contained 0.32 wt. % crude GB C12 Amide and 1.7 wt. % lactic acid together with varying amounts of differing thickeners (as indicated). FIGS. 1 and 2 compare the rheological profiles of these MTBC compositions formulated with various polysaccharides. Although xanthan gum is more effective at building consistency, compositions containing only this polysaccharide as a thickener thin very rapidly under shear. Other polysaccharides, such as guar gum, exhibit a rheology profile that shows a greater resistance to shear (i.e., less shear thinning). This could allow cleaning agent based on a GB C12 Amide/guar gum combination to provide a greater contact time for the product on the surface of the toilet.

Table 12 provides a listing of the viscosity at lowest shear (in cPs @ 35° C.) for GB C12 Amide-based MTBC compositions having varying concentrations of the indicated thickener together with 0.32 wt. % crude GB C18:1 Amide and 1.9 wt. % lactic acid. The last entry in table 12 is an example demonstrating that crude GB C18:1 Amide can act as both a cleaning agent and a thickening agent and effectively build consistency even without any added polysaccharide in the formulation.

TABLE 12

| Thickening Agent | Conc. (wt. %) | Lowest Shear Viscosity (cPs) |
|---|---|---|
| Starch | 1 | 27 |
| | 2.5 | 1675 |
| Gelatin A | 0.5 | 43 |
| | 1 | 349 |
| K. Carrageenan | 1 | 474 |
| L. Carrageenan | 1 | 3070 |
| Pectin | 1 | 31 |
| | 2.5 | 586 |
| Xanthan | 0.5 | 5804 |
| | 1 | 10350 |
| Guar Gum | 0.5 | 762 |
| | 1 | 9767 |
| GB C18:1 (Oleic) Amide crude* | 5 | 1253 |

*5 wt. % crude GB C18:1 Amide w/1.9 wt. % lactic acid

ILLUSTRATIVE EMBODIMENTS

Reference is made in the following to a number of illustrative embodiments of the subject matter described herein. The following embodiments describe illustrative embodiments that may include various features, characteristics, and advantages of the subject matter as presently described. Accordingly, the following embodiments should not be considered as being comprehensive of all of the possible embodiments or otherwise limit the scope of the methods, materials and compositions described herein.

In one aspect, the present technology provides a liquid cleaning composition including (a) a glycine betaine amide of formula (I):

$$Me_3N^+—CH_2—C(O)—NH—RX^- \quad (I)$$

wherein R is an aliphatic group having 8 to 22 carbon atoms; (b) an acidifying agent; (c) polysaccharide thickener; and (d) water; wherein the composition may have a pH of no more than about 4, a viscosity of no more than about 1,500 cP at a shear rate of 10 at 25° C., and a viscosity of at least about 250 cP at a shear rate of 50 at 25° C. (viscosities determined with a Brookfield Cone/Plate viscometer); and $X^-$ represents an inorganic or organic counterion.

In some embodiments, the composition may further include an aliphatic amine $RNH_2$, wherein the R group is as defined herein. In some embodiments, the weight ratio of the glycine betaine amide to the aliphatic amine may be about 10:1 to 1:2. The glycine betaine amide may include a mixture of glycine betaine amides having R groups with 12 carbon atoms and 14 carbon atoms; and the composition may further include a mixture of fatty amines ($RNH_2$) having R groups with 12 carbon atoms and 14 carbon atoms. In some embodiments, the R group is the aliphatic group of a fatty amine. In some embodiments, the R group may be an aliphatic group of a $C_{10}$, $C_{12}$, $C_{14}$, and/or $C_{16}$ alkyl group. In some embodiments, the R group may be a $C_{10}$-$C_{16}$ aliphatic group. In some embodiments, the R group may be a $C_8$-$C_{22}$ linear aliphatic group. In some embodiments, the R group may be a $C_8$, $C_{10}$, $C_{12}$, $C_{14}$, $C_{16}$ and/or $C_{18}$ alkyl group and/or an oleic group. In some embodiments, the R group may be a lauric, myristic, palmitic, stearic, and/or oleic group. In some embodiments, the R group may be an aliphatic group of a linear primary amine having 8 to 18 carbon atoms. In some embodiments, the $X^-$ represents a methanesulfonate anion. In some embodiment, the $X^-$ represents a methanesulfonate anion and the R group includes a lauric and/or myristic group.

The polysaccharide thickener may include xanthan gum and/or guar gum. In some embodiments, the polysaccharide may include starch or a modified starch. In some embodiments, the polysaccharide thickener includes starch, modified starch, agar, carrageenan, pectin, alginate, pectin, cellulose, and/or a cellulose derivative. The polysaccharide thickener may include a natural gum. In some embodiments, the natural gum may include agar, carob gum, guar gum, gellan gum, xanthan gum, and/or acacia gum.

In some embodiments, the acidifying agent may include hydrochloric acid. In some embodiments, the acidifying agent may include a hydroxycarboxylic acid. The hydroxycarboxylic acid may include lactic acid, citric acid, tartaric acid, gluconic acid, and/or glutaric acid. In some embodiments, the acidifying agent may include lactic acid and/or citric acid.

In some embodiments, the composition may include: about 0.1-15 wt. % of the glycine betaine amide; about 0.5-10 wt. % of the acidifying agent; about 0.5-5 wt. % of the polysaccharide thickener; and at least about 90 wt. % water. In some embodiments, the composition may include: (a) about 0.1-5 wt. % of the glycine betaine amide; (b) about 0.5-10 wt. % of the acidifying agent; (c) about 0.5-5 wt. % of the polysaccharide thickener; and (d) at least about 90 wt. % water. In some embodiments, the composition may include: about 0.1-3 wt. % of the glycine betaine amide; about 0.5-5 wt. % of the acidifying agent, which may include a hydroxycarboxylic acid; about 0.5-3 wt. % of the polysaccharide thickener, which may include a natural gum; and at least about 90 wt. % water. In some embodiments, the composition may include: about 0.1-3 wt. % of the glycine betaine amide; about 0.5-10 wt. % of the acidifying agent, which may include a mineral acid; about 0.5-5 wt. % of the polysaccharide thickener, which may include starch and/or a modified starch; and at least about 90 wt. % water. In some embodiments, the composition may include: about 0.1-3 wt. % of the glycine betaine amide; about 0.5-5 wt. % of the acidifying agent, which may include a hydroxycarboxylic acid; about 0.5-5 wt. % of the polysaccharide thickener, which may include starch and/or a modified starch; and at least about 90 wt. % water.

In some embodiments, in addition to the glycine betaine amide, the composition may further include a glycine betaine ester of formula (II):

$$Me_3N^+—CH_2—C(O)—O—RX^- \quad (II)$$

wherein R is an aliphatic group having 8 to 22 carbon atoms; and $X^-$ represents an inorganic or organic counterion.

In some embodiments, the composition may further include glycine betaine and/or methanesulfonic acid and/or a salt thereof.

In some embodiments, the composition may have a viscosity of about 250 to 1,200 cP at a shear rate of 10 at 25° C. The composition may have a viscosity of about 150 to 1000 cP at a shear rate of 50 at 25° C. In some embodiments, the composition may have a 10/50 shear rate ratio of no more than about 3. In some embodiments, the composition may have a 10/50 shear rate ratio of no more than about 2.5.

In some embodiments, the composition may include: (a) about 0.1-1 wt. % of the glycine betaine amide; (b) about 1-4 wt. % of the acidifying agent, which may include lactic and/or citric acid; (c) about 0.2-1 wt. % of a natural gum thickener; and (d) at least about 95 wt. % water. Such a composition may have a pH of no more than about 3, a 10/50 shear rate ratio of no more than about 3, and/or a viscosity of at least about 250 at a shear rate of 50 at 25° C.

In some embodiments, the composition may include: (a) about 0.1-1 wt. % of the glycine betaine amide; (b) about 1-10 wt. % of the acidifying agent, which may include lactic and/or citric acid; (c) about 1-4 wt. % of a thickener, which may include starch and/or a modified starch; and (d) at least about 90 wt. % water. Such a composition may have a pH of no more than about 3, a 10/50 shear rate ratio of no more than about 3, and/or a viscosity of at least about 250 at a shear rate of 50 at 25° C.

In some embodiments, the composition may include: (a) about 0.1-1 wt. % of the glycine betaine amide; (b) about 1-10 wt. % of the acidifying agent, which may include hydrochloric acid; (c) about 0.2-1 wt. % of a natural gum thickener; and (d) at least about 90 wt. % water. Such a composition may have a pH of no more than about 1.5 (typically no more than about 1), a 10/50 shear rate ratio of no more than about 3, and/or a viscosity of at least about 250 at a shear rate of 50 at 25° C.

In some embodiments, the composition may include: (a) about 0.1-1 wt. % of the glycine betaine amide; (b) about 1-10 wt. % of the acidifying agent, which may include hydrochloric acid; (c) about 1-4 wt. % of a thickener, which may include starch and/or a modified starch; and (d) at least about 85 wt. % water. Such a composition may have a pH of no more than about 1, a 10/50 shear rate ratio of no more than about 3, and/or a viscosity of at least about 250 at a shear rate of 50 at 25° C.

In some embodiments, the present composition may be a liquid cleaning composition which includes (a) a glycine betaine amide of formula (I):

$$Me_3N^+—CH_2—C(O)—NH—RX^- \quad (I)$$

wherein R is an aliphatic group having 8 to 22 carbon atoms; and X— represents an inorganic or organic anion; (b) an acidifying agent; (c) polysaccharide thickener; and (d) water. The composition may have a pH of no more than about 3, a 10/50 shear rate ratio of no more than about 3, and/or a viscosity of at least about 250 at a shear rate of 50 at 25° C. In certain embodiments, the composition may include about 0.1-3 wt. % of the glycine betaine amide; about 0.1-3 wt. % of the acidifying agent; about 0.1-4 wt. % of the polysaccharide thickener; and at least about 90 wt. % water. The acidifying agent may include an organic acid, such as lactic acid, glycolic acid, citric acid, acetic acid, malonic acid, succinic acid, tartaric acid gluconic acid, glutaric acid and/or methanesulfonic acid.

While certain embodiments have been illustrated and described, it should be understood that changes and modifications can be made therein in accordance with ordinary skill in the art without departing from the technology in its broader aspects.

The embodiments, illustratively described herein may suitably be practiced in the absence of any element or elements, limitation or limitations, not specifically disclosed herein. Thus, for example, the terms "comprising," "including," "containing," shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof.

What is claimed is:

1. An aqueous liquid cleaning composition comprising (a) about 0.1-3 wt. % of a glycine betaine amide of formula (I):

$$Me_3N^+—CH_2—C(O)—NH—RX^- \quad (I)$$

wherein R is an aliphatic group having 8 to 22 carbon atoms;

(b) about 0.5-5 wt. % of an acidifying agent, which comprises mineral acid;

(c) about 0.1-3 wt. % of a polysaccharide thickener, which comprises guar gum and/or pectin;

(d) a salt of an aliphatic amine $RNH_2$, wherein the R group is as defined;

(e) a glycine betaine ester of formula:

$$Me_3N^+—CH_2—C(O)—O—R'X^-$$

wherein R' is an n-butyl group and $X^-$ is as defined; and (f) at least about 90 wt. % water;

wherein the composition has a pH of no more than about 1, a viscosity of no more than about 1,500 cP at a shear rate of 10 at 25° C., and a viscosity of at least about 150 cP at a shear rate of 50 at 25° C. (viscosities determined with a Brookfield Cone/Plate viscometer); and $X^-$ represents an inorganic or organic counterion.

2. The composition of claim 1, wherein the weight ratio of the glycine betaine amide to the aliphatic amine and/or salt thereof is about 10:1 to 1:2.

3. The composition of claim 1, wherein the polysaccharide thickener comprises guar gum.

4. The composition of claim 1, wherein the polysaccharide thickener further comprises agar, carrageenan, alginate, cellulose, and/or a cellulose derivative; and the R group includes a lauric and/or myristic group.

5. The composition of claim 1, wherein the polysaccharide further comprises starch and/or a modified starch.

6. An aqueous liquid cleaning composition comprising (a) a glycine betaine amide of formula (I):

$$Me_3N^+—CH_2—C(O)—NH—RX^- \quad (I)$$

wherein R is an aliphatic group having 8 to 22 carbon atoms; $X^-$ represents an inorganic and/or organic counterion and comprises a methanesulfonate anion;

(b) an acidifying agent, which includes mineral acid;

(c) polysaccharide thickener, which comprises guar gum;

(d) a methanesulfonate salt of an aliphatic amine $RNH_2$, wherein the R group is as defined;

(e) a glycine betaine ester of formula:

$$Me_3N^+—CH_2—C(O)—O—R'X^-$$

wherein R' is an n-butyl group and $X^-$ is as defined; and (f) at least about 90 wt. % water;

wherein the composition has a pH of no more than about 1, a viscosity of no more than about 1,500 cP at a shear rate of 10 at 25° C., and a viscosity of at least about 150 cP at a shear rate of 50 at 25° C. (viscosities determined with a Brookfield Cone/Plate viscometer); and the weight ratio of the glycine betaine amide to the aliphatic amine and/or salt thereof is about 10:1 to 1:2.

7. The composition of claim 6, wherein the $X^-$ comprises a methanesulfonate anion; the R group comprises a lauric and/or myristic group; and the polysaccharide further comprises a natural gum selected from the group consisting of agar, carob gum, gellan gum, xanthan gum, acacia gum and mixtures thereof.

8. The composition of claim 7, wherein the composition has a viscosity of about 150 to 1000 cP at a shear rate of 50 at 25° C. and a 10/50 shear rate ratio of no more than about 2.5; and the acidifying agent includes hydrochloric acid.

9. The composition of claim 6, wherein the polysaccharide thickener further comprises starch and/or a modified starch; and the $X^-$ comprises a methanesulfonate anion; and the salt of the aliphatic amine $RNH_2$ comprises a methanesulfonate salt.

10. The composition of claim 6, wherein the composition comprises about 0.1-3 wt. % of the glycine betaine amide;

about 0.5-10 wt. % of the acidifying agent; and about 0.1-5 wt. % of the polysaccharide thickener.

11. An aqueous liquid cleaning composition comprising:

(a) about 0.1-3 wt. % of a glycine betaine amide of formula (I):

$$Me_3N^+—CH_2—C(O)—NH—RX^- \quad (I)$$

wherein R is an aliphatic group having 8 to 22 carbon atoms; and $X^-$ represents an inorganic or organic counterion;

(b) about 1-5 wt. % acidifying agent, which includes mineral acid;

(c) about 1-5 wt. % polysaccharide thickener, which comprises guar gum;

(d) a salt of an aliphatic amine $RNH_2$, wherein the R group is as defined;

(e) a glycine betaine ester of formula:

$$Me_3N^+—CH_2—C(O)—O—R'X^-$$

wherein R' is an n-butyl group and $X^-$ is as defined; and (f) at least about 90 wt. % water;

wherein the weight ratio of the glycine betaine amide to the aliphatic amine salt is about 10:1 to 1:2; and the composition has a pH of no more than about 1; a viscosity of no more than about 1,500 cP at a shear rate of 10 at 25° C. and a viscosity of at least about 250 at a shear rate of 50 at 25° C. (each as determined with a Brookfield Cone/Plate viscometer).

12. The composition of claim 11, wherein the glycine betaine amide comprises one or more glycine betaine amides having R groups with 12 carbon atoms and 14 carbon atoms;

the aliphatic amine salt comprises a methanesulfonate salt of a fatty amine $RNH_2$, wherein the R group is selected from fatty aliphatic groups with 12 carbon atoms and/or 14 carbon atoms.

13. The composition of claim 11, wherein R is an aliphatic group having 12 to 18 carbon atoms; $X^-$ comprises a methanesulfonate anion; the salt of the aliphatic amine $RNH_2$ comprises a methanesulfonate salt of the aliphatic amine $RNH_2$; and the mineral acid comprises hydrochloric acid.

14. The composition of claim 11, wherein the polysaccharide thickener further comprises pectin.

15. The composition of claim 1, wherein the $X^-$ comprises a methanesulfonate anion; and the salt of the aliphatic amine $RNH_2$ comprises a methanesulfonate salt.

16. The composition of claim 1, wherein the R group comprises a lauric and/or myristic group.

17. The composition of claim 1, wherein the composition comprises at least about 1 wt. % hydrochloric acid.

18. The composition of claim 6, wherein the composition comprises at least about 1 wt. % hydrochloric acid.

19. The composition of claim 11, wherein the $X^-$ comprises a methanesulfonate anion; and the salt of the aliphatic amine $RNH_2$ comprises a methanesulfonate salt.

20. The composition of claim 19, wherein the glycine betaine amide comprises a mixture of glycine betaine amides having R groups with 12 carbon atoms and 14 carbon atoms; and the aliphatic amine $RNH_2$ comprises a mixture of fatty amines $RNH_2$ having R groups with 12 carbon atoms and 14 carbon atoms.

21. The composition of claim 11, wherein the composition comprises at least about 1 wt. % hydrochloric acid.

22. The composition of claim 11, wherein the composition has a 10/50 shear rate ratio of no more than about 3.

23. The composition of claim 11, wherein the acidifying agent includes hydrochloric acid; and the composition has a 10/50 shear rate ratio of no more than about 3.

24. The composition of claim 11, wherein the R group comprises a lauric and/or myristic group.

25. The composition of claim 11, wherein the R group comprises a palmitic, stearic, and/or oleic group.

* * * * *